US006173791B1

(12) United States Patent
Yen

(10) Patent No.: US 6,173,791 B1
(45) Date of Patent: Jan. 16, 2001

(54) FIRE PROTECTION SYSTEM USING WATER MIST

(76) Inventor: Ping-Li Yen, 185 W. Norman Ave., Arcadia, CA (US) 91007

( * ) Notice: Under 35 U.S.C. 154(b), the term of this patent shall be extended for 0 days.

(21) Appl. No.: 09/441,278

(22) Filed: Nov. 16, 1999

(51) Int. Cl.[7] ..... A62C 2/00
(52) U.S. Cl. ..... 169/47; 169/65
(58) Field of Search ..... 169/47, 56, 65, 169/67, 66

(56) References Cited

U.S. PATENT DOCUMENTS

| | | | | |
|---|---|---|---|---|
| 3,463,233 | * | 8/1969 | Haessler | 169/65 |
| 3,584,688 | * | 6/1971 | Duncan | 169/65 |
| 3,653,443 | | 4/1972 | Dockery . | |
| 3,691,936 | * | 9/1972 | Chiarelli | 169/65 |
| 3,866,687 | | 2/1975 | Banner . | |
| 3,889,754 | * | 6/1975 | Dunn | 169/65 |
| 4,356,870 | | 11/1982 | Gaylord et al. . | |
| 4,524,835 | | 6/1985 | Mingrone . | |
| 4,813,487 | | 3/1989 | Mikulec et al. . | |
| 4,834,188 | * | 5/1989 | Siverman | 169/65 |
| 5,127,479 | | 7/1992 | Stehling et al. . | |
| 5,129,386 | * | 7/1992 | Meister | 169/65 |
| 5,165,483 | * | 11/1992 | Fox | 169/47 |
| 5,297,636 | | 3/1994 | North . | |
| 5,697,450 | | 12/1997 | Stehling et al. . | |
| 5,871,057 | | 2/1999 | Stehlin et al. . | |

* cited by examiner

*Primary Examiner*—Andres Kashnikow
*Assistant Examiner*—Dinh Q. Nguyen
(74) *Attorney, Agent, or Firm*—William W. Haefliger

(57) ABSTRACT

The method of extinguishing a fire characterized by production of flames openly rising above an upwardly presented liquid fat or grease zone, in a fryer, the fat or grease being combustible to produce the fire, the steps that include locating a mist forming nozzle to direct mist toward the flames, delivering essentially pure water under pressure to the nozzle so that the nozzle forms a jet stream of water mist delivered form the nozzle as a rapid and expanding Oflow of concentrated mist, and directing said mist stream into the flames to substantially encompass the flames, and to flow toward the fat or grease zone, and for a sufficient time to extinguish the flames and to lower the temperature of the surface of the fat or grease zone to a level below combustion temperature.

10 Claims, 5 Drawing Sheets

13
11
11a
20
11b
22
12
12a
10b
10
10a

FIRE PROTECTION SYSTEM USING WATER MIST

BACKGROUND OF THE INVENTION

This invention relates generally to suppression of accidental fires involving cooking oil or fat, and more particularly concerns employment of pure water mist in such suppression, as well as extinction of such fires.

In recent years, the development of high-efficiency cooking equipment with high energy input rates and the widespread use of vegetable oils with high burning temperature have increased potential risks to life and property loss. Almost 50% of all accidental fires in hotels, restaurants and fast food outlets start in kitchens and the majority of these involve liquid cooking oil or fat fires. These fires are the hardest to extinguish and are easily re-ignited. Suppressing cooking oil fires has been identified as the primary fire challenge in restaurant cooking areas. Recently cooking oil fires, due to their different behavior from other types of liquid fuel fires, were re-classified into a new class of fire, Class K, by the National Fire Protection Association (NFPA); a similar classification is also being considered by the Loss Prevention Council and other agencies around the world.

Previous studies showed that foam, powder and carbon dioxide are not as effective in suppressing cooking oil fires as they are for other types of liquid fuel fires. Currently, wet chemical agents, as defined by NFPA-17A, are the primary means used to extinguish grease fires in cooking areas. They are effective in extinguishing these fires, but may cause irritation to the skin and eyes as well as clean-up problems after fire extinguishment. Furthermore, the system cost of wet chemical agents is relatively high. As a result, there is a significant need for improving fire safety and reducing the cost of protecting restaurant cooking areas through the introduction of a new effective extinguishing system.

SUMMARY OF THE INVENTION

It is a major object of the invention to provide method and apparatus to efficiently and effectively suppress such fires, through use of water mist. Such mists are non-toxic, and do not contribute to environmental problems.

Basically, the invention provides a method of extinguishing a fire characterized by production of flames openly rising above an upwardly presented liquid fat or grease zone, the fat or grease being combustible to produce the fire. The steps of the method include a) locating a mist forming nozzle to direct mist toward the rising flames, b) delivering essentially pure water under pressure to the nozzle so that the nozzle forms a jet stream of water mist delivered from the nozzle as a rapid expanding flow of concentrated mist, c) and directing the mist stream into the flames to substantially encompass the flames, and to flow toward the fat or grease zone, and for a sufficient time to extinguish the flames and to lower the temperature of the surface of the fat or grease zone to a level below combustion temperature.

It is another object of the invention to carry out the above step c) to effect rapid conversion of such mist to steam, which expands outwardly about the fat or grease zone, and rapidly blankets or hovers closely about that zone, blocking air or oxygen access to the fat or grease zone.

Another object is to locate the mist forming nozzle directly above said zone and at a spacing such that the downward stream of mist expands in flowing downwardly, to quickly encompass cool, and extinguish the flames.

Rapid mist stream formation and travel into the flames is effected by supply of pure water to the nozzle at a pressure level between 220 and 450 psi, and preferably above 245 psi. Also, the length of time needed for mist stream delivery toward the fat or grease zone is typically less than about 10 seconds, for effecting flame extinction. The use of mist instead of water droplets assures such rapid flame extinction, since mist provides maximum water surface area exposed to the flame, with wide area distribution.

Another object is to eliminate electrical or gas heating of the fat or grease in conjunction with flow of mist into the flames. For that purpose, the method may include detecting the presence of flames, and then effecting delivery of the water under pressure to the nozzle, to form the mist.

A yet further object includes provision of a portable carrier, and storing water under pressure on the carrier, and in a position to be delivered to the nozzle. A water storage vessel may be provided on the carrier, the vessel having an outlet for water to be delivered to the nozzle, and providing a conduit connecting such outlet to nozzle. The portable carrier is then easily located near a fat fryer installation to be protected as in a restaurant, in accordance with the invention.

These and other objects and advantages of the invention, as well as the details of an illustrative embodiment, will be more fully understood from the following specification and drawings, in which:

DRAWING DESCRIPTION

DETAILED DESCRIPTION

Figure 1:
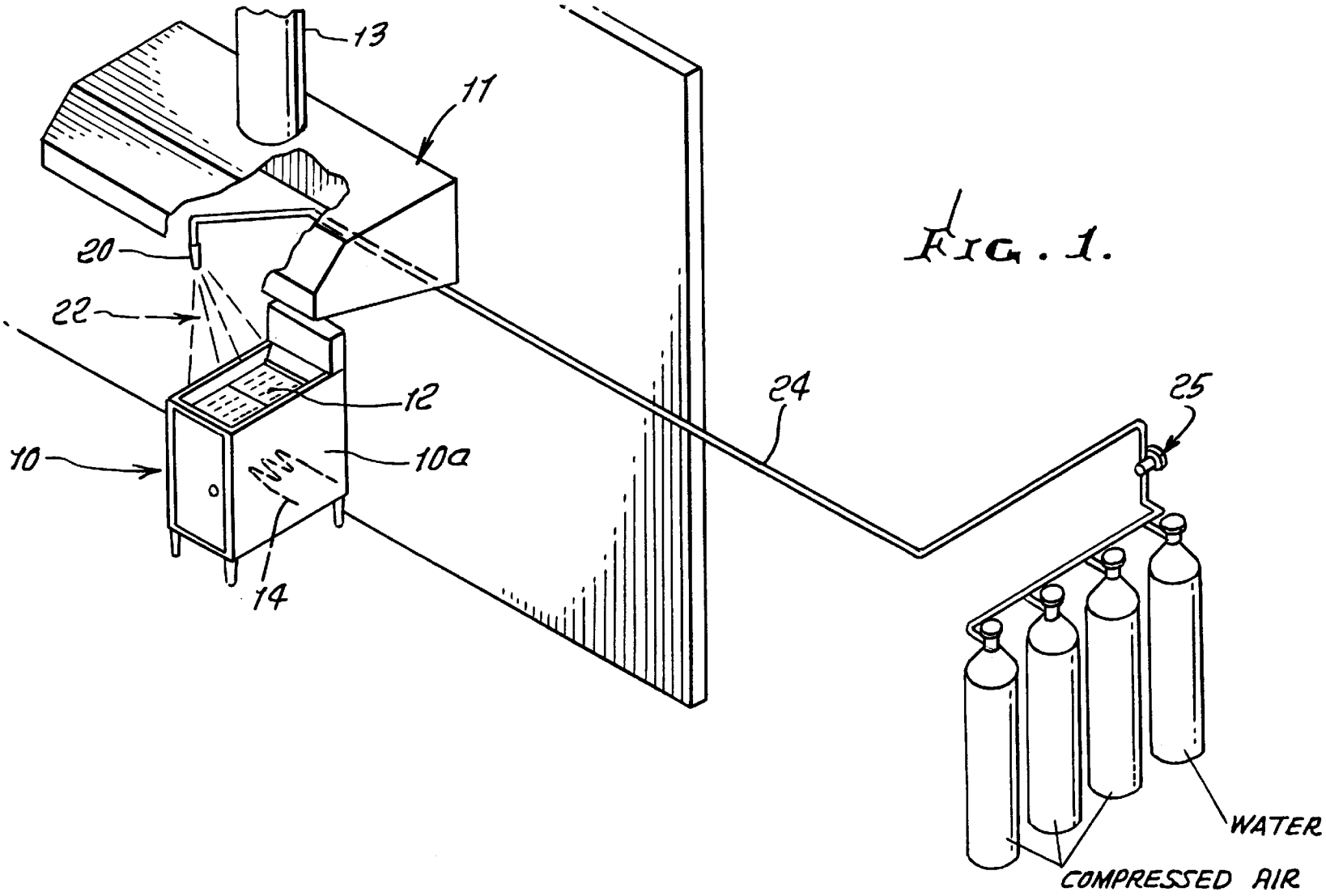
FIG. 1 is a view showing a system employing the invention.
Figure 2:
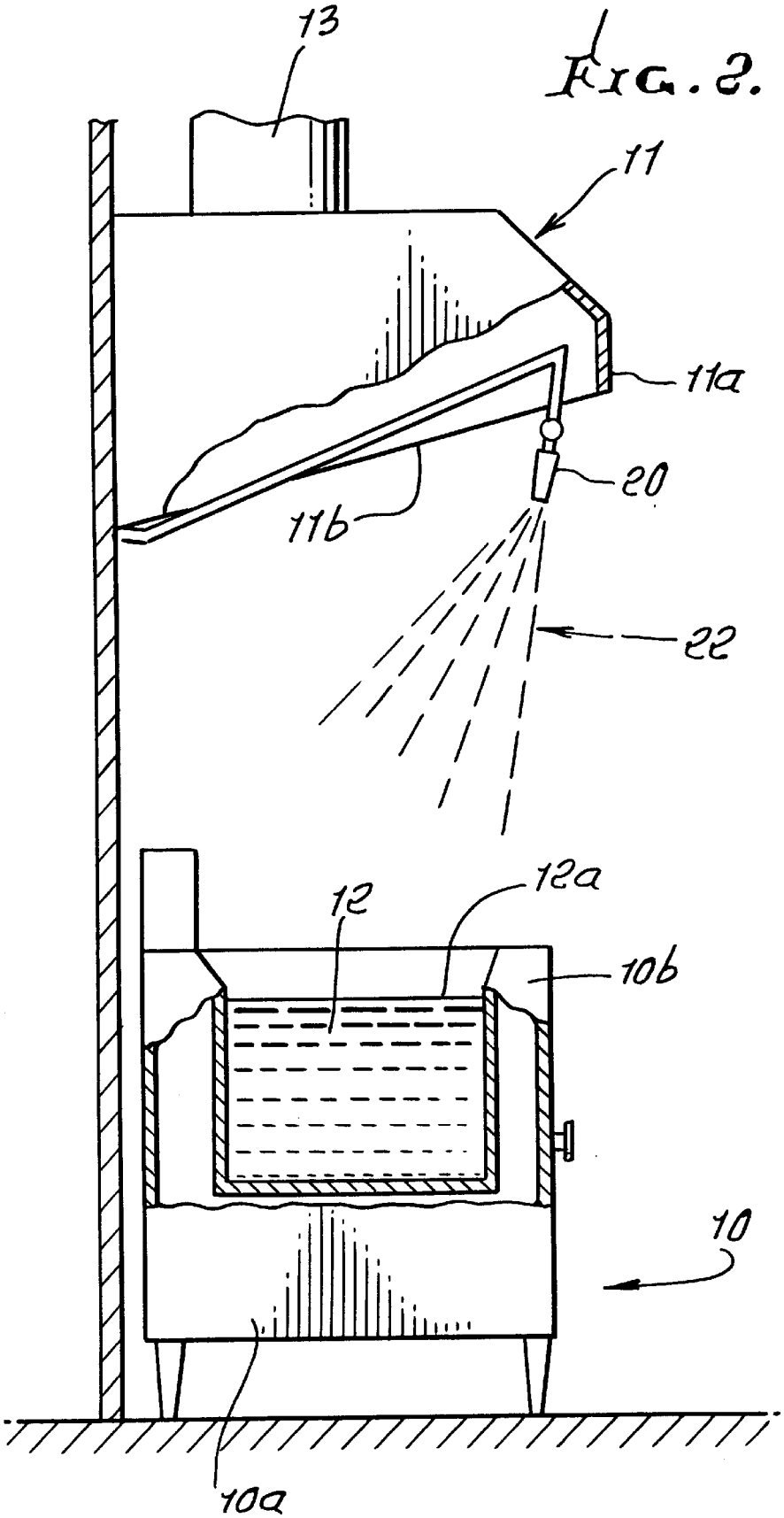
FIG. 2 is an enlarged vertical section taken through a fryer unit, a hood, and showing positioning of a nozzle below the hood and above a liquid fat zone in the fryer unit.
Figure 3:
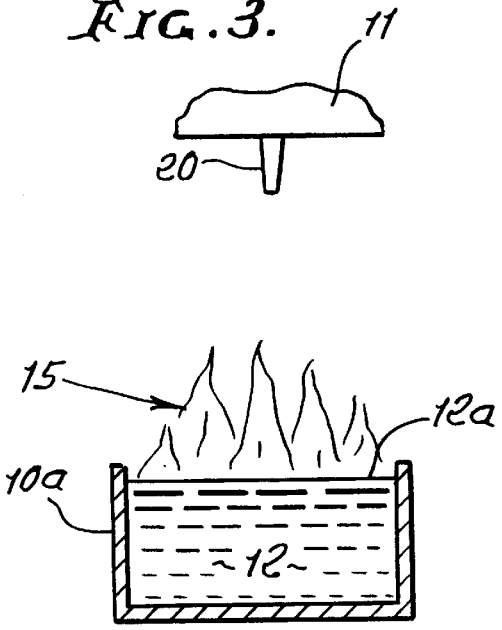
FIGS. 3–6 are diagrammatic elevational views, showing stages in flame and fire suppression, using directed mist.

In FIGS. 1 and 2, a fryer unit 10 is positioned below a hood 11. Fumes rising from cooking oil or fat 12 in the receptacle or vessel 10*a* of unit 10 collect in the hood and are exhausted via a duct 13. The fat 12 is typically heated to elevated temperature, as for example by electrical or gas heating means, indicated generally at 14, and it is highly desirable to provide equipment operable to quickly and effectively suppress a fire or flames that may occur, as indicated at 15 in FIG. 3. Such flames otherwise tend to rapidly grow due to rising temperature at the surface zone 12*a* of the fat in the fryer, and if the flames continue to rise toward and closer to the hood, there is extreme danger of outbreak of fire in the hood, risking outbreak of fire in a building structure containing the fryer and hood.

In accordance with the invention, a mist forming nozzle 20 is located at a position to direct water mist in a stream toward the flames 15. See the nozzle operating in FIG. 4, after outbreak of flames, to deliver pure (non-chemically contaminated) aqueous mist in a downward conical stream indicated at 22. In this regard, essentially pure water is delivered at 24 under controlled pressure (see control 25 in FIG. 4) to the nozzle, such that the nozzle forms a stream of water mist delivered from the nozzle as a rapid flow of concentrated mist. Further, the forceful mist stream is directed into the flames to to substantially encompass the flames, and to flow toward the fat or grease zone, and for a sufficient time to extinguish the flames and to lower the temperature of the surface of the fat or grease zone to a level below combustion temperature. Water mist droplets have very great total surface area, acting to rapidly lower temperature in the flame area and fat zone 12*a*. Usable mist particles are less than 1000 microns in cross section. Water under gaseous (for example $N_2$) pressure preferably between about 170 and 250 psi is sufficient to form such mist particles at the nozzle, and to drive them onto the fire, as at a fryer, to very rapidly extinguish the fire, and without excessive pressure as would slow down the extinction.

Figure 4:
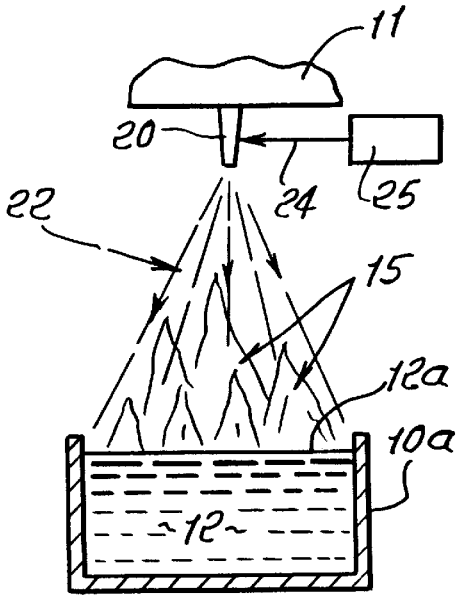
Figure 5:
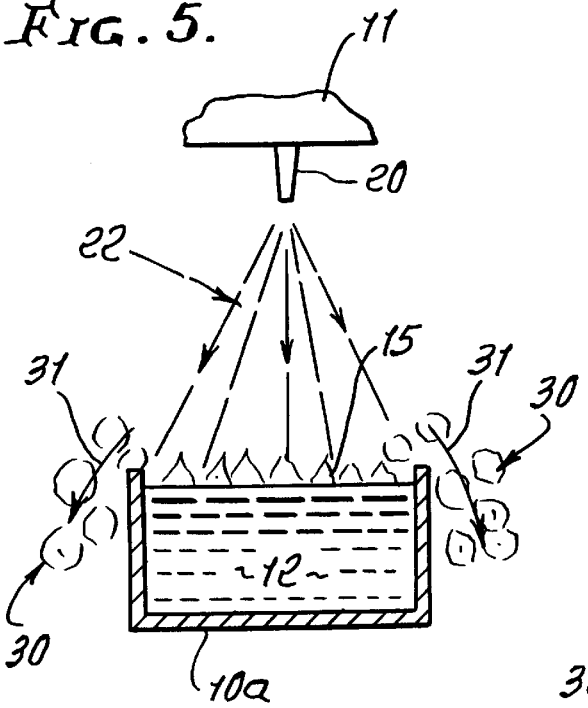
Figure 6:
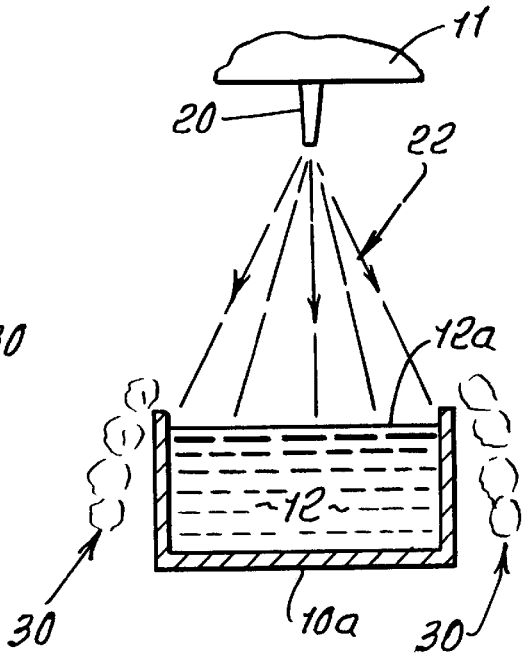

Note further in FIGS. 4–6 that the downward mist stream cone 22 diverges to substantially encompass the area of the fat surface zone 12*a* in the fryer. FIG. 4 shows initial suppression and lowering of the flames 15; FIG. 5 shows substantially complete suppression of the rising flames 15 by continued mist delivery; and in FIG. 6, the flames have been extinguished and the surface zone 12*a* of the fat in the fryer is being cooled by the mist from cone 22. FIGS. 5 and 6 also show conversion of some of the mist to steam, by contact with flames and hot fat, the steam billowing at 30 laterally from the zone 12*a*, and downwardly at 31 adjacent the fryer unit, blocking or interrupting flow of air and oxygen to the zone 12*a* and to the flames, assisting in flame suppression.

For best results, water delivery pressure to nozzle 20 should be between 220 and 280 psi; and preferably such pressure should be between 245 and 255 psi. The time for mist flow in sufficient quantity to extinguish the flames, as in the sequence of FIGS. 4–6, is less than 10 seconds, and mist flow may be continued to cool the surface of the fat in the fryer to a level below about 180° C., to assure against spontaneous re-combustion.

FIG. 2 also shows support of the nozzle by the front lla of the hood, and inclined rearwardly at an angle of about 4° to 10° from vertical toward the front 10*b* of the fryer, to assure that flames rising from the front of the fryer, where the cook is situated, will be extinguished first. Note also that the nozzle is proximate the downward facing entrance 11*b* to the hood.

Figure 7:
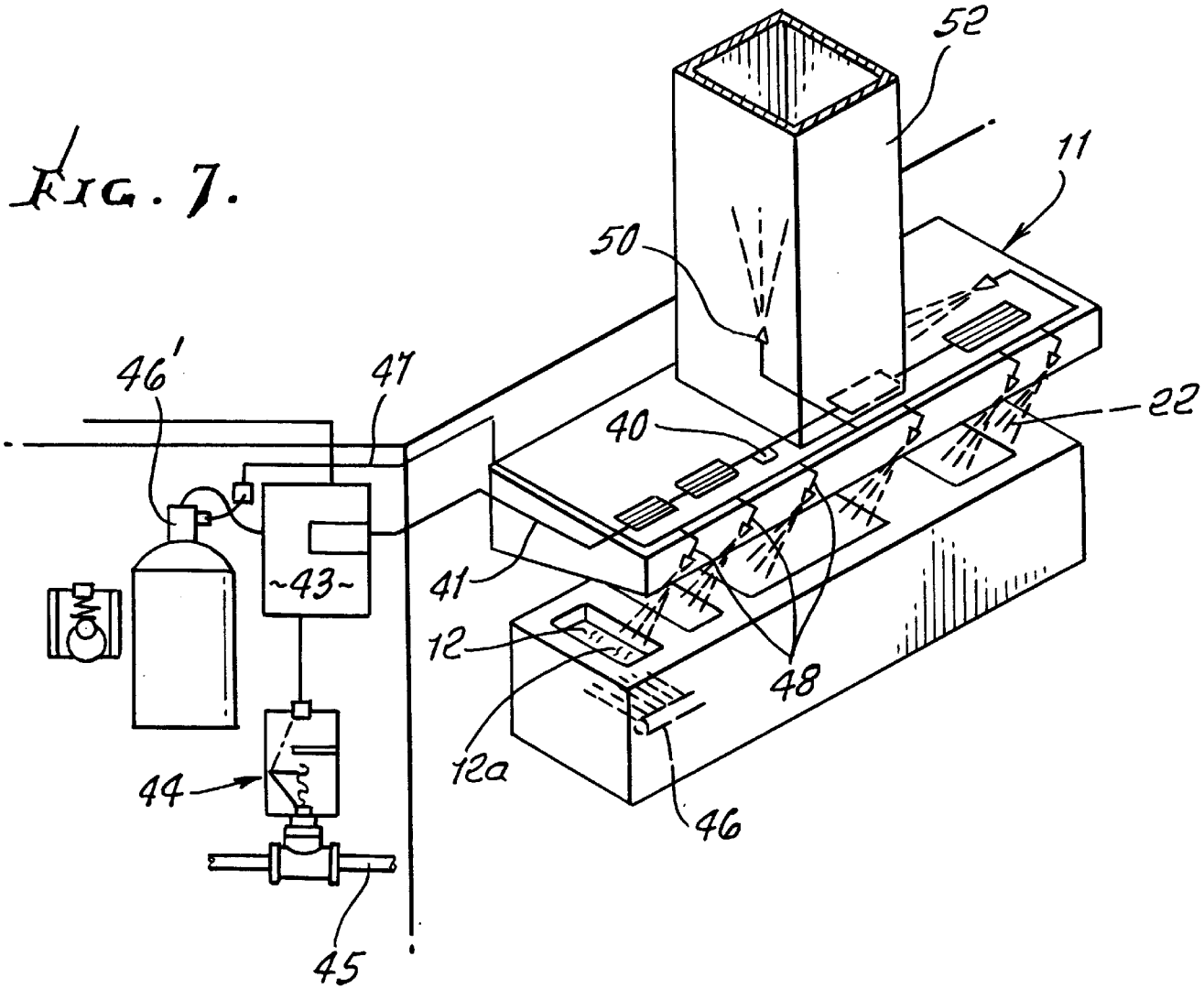
FIG. 7 is a system diagram, showing flame detection and resulting interruption of fat or grease heating.

FIG. 7 shows the step, and equipment, for eliminating or reducing heating of the fat or grease 12, in conjunction with directing mist toward the surface zone 12*a*. Such elimination or reduction includes first detecting the presence of said flames, and then effecting delivery of water under pressure to the nozzle. In that example, a fusible device 40 is provided in line 41, attached to the hood 11. Excessive heat, as from a fire and flames 15, causes fusion of device 40, which transmits an electrical signal via line 41 to a control 43. Operation of the control stops such heating, as for example by causing closing of a solenoid valve 44 in a fuel line 45 to burners 46 that heat the fat. If heating is by electrical means, operation of control 43 stops flow of current to the electrical heater.

The control 43 may also serve to open water supply valve 46' in the line 47 leading to the nozzle or nozzles. Multiple nozzles 48 may be used, as shown in FIG. 7; and an additional nozzle or nozzles 50 may be provided in the hood exhaust duct 52, to spray mist and lower the duct interior temperature to levels well below grease combustion temperature.

Figure 8:
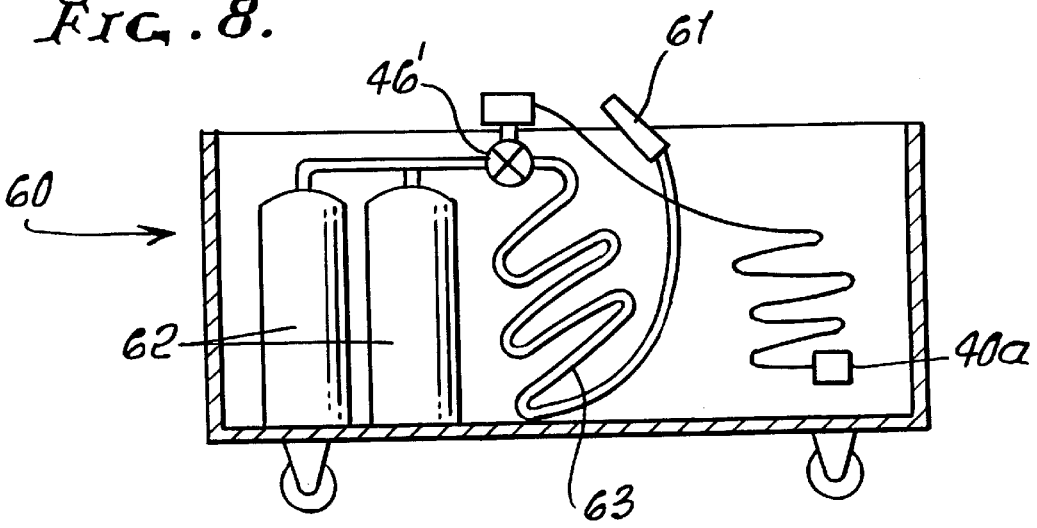
FIG. 8 is an elevation showing a portable system, employing the invention.

FIG. 8 shows a portable carrier 60 for the apparatus, including a nozzle 61 to be installed as described; a tank or tanks 62 to contain pure water under pressure; a flexible duct 63 leading from the tanks to the nozzle; a control valve 46 in that duct; and a temperature detector or fusible device 40*a* operatively connected to valve 46, as referred to.

Figure 9:
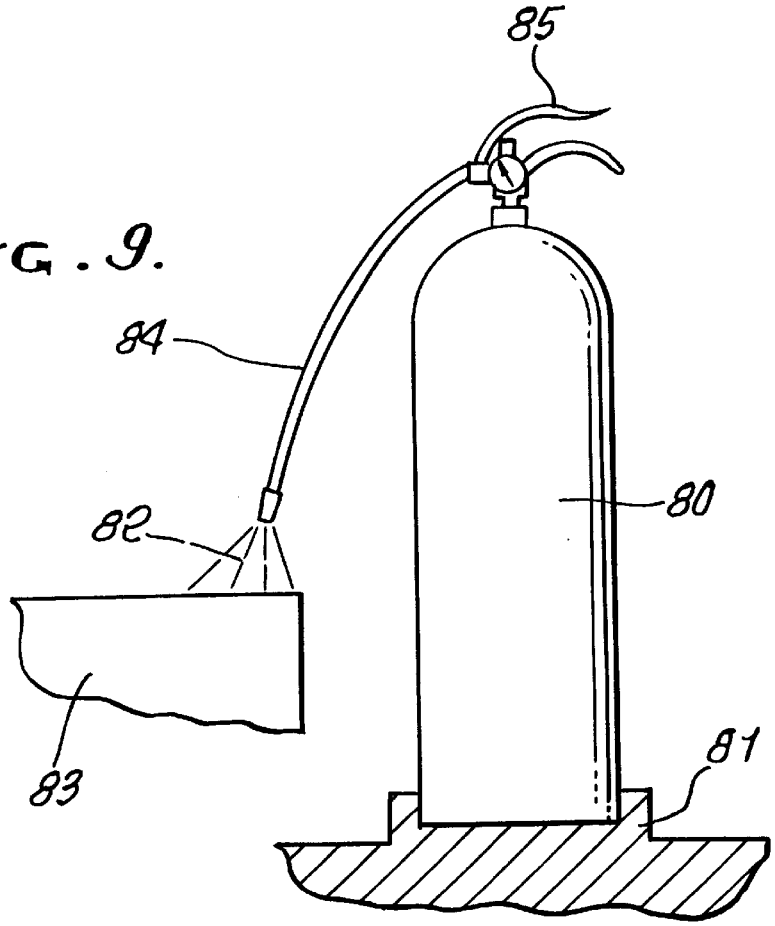
FIG. 9 is an elevation showing a modified system.

FIG. 9 shows another portable carrier 80 in the form of an upright pressure vessel containing water under pressure, and a portable or movable support 81. Mist 82 is released toward fryer 83, from a hose 84, when control handle 85 is depressed.

Examples of operation are as follows:

EXAMPLE 1

One overhead impingement nozzle, P120, was used in a Test F-1. The position of inclination of the nozzle was as in FIG. 2, and the distance of the nozzle from the fuel surface was 860 mm. The nozzle was inclined toward the back of the fryer. The water mist discharge pressure was maintained at 24.1 bar (350 psi) during the test.

The liquid cooking oil in the fryer was heated continuously at a certain rate (7° C./min) until it auto-ignited at a temperature of 368° C. The fire became fully developed from a small flame on the oil surface to a large fire reaching toward the overhead hood. The temperature of the cooking oil further increased by the large flame to 396° C., which was 28° C. higher than its auto-ignition temperature. The water mist system was then activated, and the downwardly forcefully flowing mist pushed the flame toward the back of the fryer. The cooking oil fire was thereby instantly extinguished. The water mist discharge was maintained for 15 seconds and the cooking oil temperature cooled down quickly from nearly 400° C. to 280° C. When the water mist discharge was stopped, the cooking oil temperature rose within six seconds to 330° C., and the cooking oil auto-re-ignited. Another water mist discharge of 2 seconds extinguished the fire again. Fifteen seconds after the second fire extinguishment, however, the oil in the fryer again auto-re-ignited at a temperature of approximately 300° C. The fire was extinguished again by a 5 second water mist discharge, and the oil temperature dropped below 200° C. No further auto-re-ignition of the cooking oil occurred. During the test, no burning oil was splashed outside the fryer, but a small amount of oil droplets were splashed outside the fryer during the water mist discharge.

EXAMPLE II

The purpose of Test F-2 was to prevent the re-ignition of the cooking oil, as had occurred in Test F-1, by extending the discharge period. Hence, in Test F-2, the nozzle location was kept the same as in Test F-1 but the discharge period of water mist was extended from 15 second to 1 min. The discharge pressure of water mist was maintained at 29.0 bar (420 psi) during the test.

The liquid oil in the fryer was heated continuously and it auto-ignited at a temperature of 365° C. The fire quickly developed fully, and the oil temperature was further increased to 390° C. The water mist system was then activated, and the fire was instantly extinguished. During the continuous water mist discharge of 1 min, a large amount of steam was produced, and the oil temperature dropped to below 200° C. No re-ignition occurred. As in Test F-1, no burning oil was splashed outside of the fryer during the test. Due to the higher discharge pressure and longer discharge period, the amount of oil droplets splashed outside of the fryer was more than that observed in Test F-1.

EXAMPLE III

In Test F-3, the same nozzle location was kept as in Test F-2 but the discharge pressure was reduced from 29.0 bar (420 psi) to 13.1 bar (190 psi). The water mist discharge period was maintained for 1 min during the test.

The liquid oil in the fryer auto-ignited at 365° C. The oil fire quickly developed fully, and the temperature of the cooking oil increased to 390° C. With water mist discharge then activated, the cooking oil fire became extinguished after 1 minute. During the test, no burning grease was splashed outside the fryer. The amount of oil droplets splashed outside the fryer was less than that in Test F-2. Water mist discharge continued for a total time of 1 minute, and no re-ignition occurred.

EXAMPLE IV

For cooing temperature splash testing, seven tests involving three types of nozzles were conducted. Test conditions included various discharge pressures and nozzle distances from the fuel surface. During the tests, the cooking oil was heated to a temperature of 190° C. and water mist was then discharged for 5 seconds. It was observed that for all seven tests, no droplets of oil were splashed outside the fryer during the 5 seconds discharge period. The oil temperature cooled from 190° C. to 170° C. The air temperature above the oil also dropped during the water mist discharge period but increased sharply when the water mist discharge was stopped.

Further testing F-10 showed that optimum water discharge pressure should be between 250 and 170 psi, for instant fire extinguishing, and no re-ignition.

I claim:

1. The method of extinguishing a fire characterized by production of flames openly rising above an upwardly presented liquid fat or grease zone, in a fryer, the fat or grease being combustible to produce the fire, the steps that include:

a) locating a mist forming nozzle to direct mist toward the flames, b) delivering essentially pure water under pressure to the nozzle so that the nozzle forms a jet stream of water mist delivered from the nozzle as a rapid and expanding flow of concentrated mist, i) said pressure to the nozzle being between 170 and 250 p.s.i., ii) and said pressure to the nozzle being at a level or levels causing mist droplets to form, and to have cross sections less than 1000 microns, c) and directing said mist stream downwardly into the flames to substantially encompass the flames, and to flow toward the fat or grease zone, and for a sufficient time, which is less than about 15 seconds, to extinguish the flames and to lower the temperature of the surface of the fat or grease zone to a level below combustion temperature, d) said nozzle being directed toward the flames from a location above the flames and directed at an angle relative to vertical, said angle being less than about 4° to 10°.

2. The method of claim 1 wherein said step a) is carried out to effect rapid conversion of mist to steam which expands outwardly about said fat or grease zone, and hovers closely about said zone.

3. The method of claim 1 wherein said nozzle is located directly above said zone and at a spacing such that the downward stream of mist expands in flowing downwardly, to quickly encompass, cool, and extinguish said flames.

4. The method of claim 1 wherein liquid fat or grease at said zone is subjected to heating prior to said fire, and including eliminating or reducing said heating, in conjunction with said step c) directing of mist into the flames.

5. The method of claim 4 including detecting the presence of said flames, and then effecting said delivering of the water under pressure to the nozzle, said liquid fat or grease at said zone being subjected to heating prior to said fire, and including eliminating or reducing said heating, in conjunction with said step c) directing of mist into the flames.

6. The method of claim 1 including detecting the pressure of said flames, and then effecting said delivering of the water under pressure to the nozzle.

7. The method of claim 1 including providing a portable carrier, and storing said water under pressure in the carrier, and in a position to be delivered to the nozzle.

8. The method of claim 1 including providing a water storage vessel on the carrier, the vessel having an outlet for water to be delivered to the nozzle, and providing a conduit connecting said outlet to nozzle.

9. The method of claim 7 wherein said fat or grease zone is produced by hot liquid fat in a receptacle, below a fume hood, and including installing the nozzle proximate the entrance to the hood, and directed downwardly and rearwardly above the forward most extent of the receptacle, so that mist streams delivered by the nozzle push the flames toward the rear of the space between the receptacle and the hood.

10. The method of extinguishing a fire characterized by production of flames openly rising above an upwardly presented liquid fat or grease zone, in a fryer, the fat or grease being combustible to produce the fire, the steps that include:

a) locating a mist forming nozzle to direct mist toward the flames, b) delivering essentially pure water under pressure to the nozzle so that the nozzle forms a jet stream of water mist delivered from the nozzle as a rapid and expanding flow of concentrated mist, i) said pressure to the nozzle being between 170 and 250 p.s.i., ii) and said pressure to the nozzle being at a level or levels causing mist droplets to form, and to have cross sections less than 1000 microns, c) and directing said mist stream downwardly into the flames to substantially encompass the flames, and to flow toward the fat or grease zone, and to convert some of the mist to steam to flow downwardly at the side of the fat or grease zone, and for a sufficient time, which is less than about 15 seconds, to extinguish the flames and to lower the temperature of the surface of the fat or grease zone to a level below combustion temperature.

* * * * *